US011412915B2

(12) United States Patent
Büsing et al.

(10) Patent No.: US 11,412,915 B2
(45) Date of Patent: Aug. 16, 2022

(54) DISH WASHER WITH LOADING FRAME

(71) Applicant: Samsung Electronics Co., Ltd., Suwon-si (KR)

(72) Inventors: Johannes Büsing, Suwon-si (KR); Woo Jin Shin, Suwon-si (KR); Chang Wook Lee, Suwon-si (KR); Sang Soo Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 61 days.

(21) Appl. No.: 16/456,220

(22) Filed: Jun. 28, 2019

(65) Prior Publication Data

US 2020/0046198 A1 Feb. 13, 2020

(30) Foreign Application Priority Data

Aug. 7, 2018 (KR) ..... 10-2018-0091839

(51) Int. Cl.
*A47L 15/50* (2006.01)

(52) U.S. Cl.
CPC ..... *A47L 15/507* (2013.01); *A47L 15/502* (2013.01)

(58) Field of Classification Search
CPC ..... A47L 15/507
See application file for complete search history.

(56) References Cited

U.S. PATENT DOCUMENTS 3,194,610 A 7/1965 Stewart
3,672,743 A * 6/1972 Pompey ..... B60B 33/0063 312/352
2008/0072631 A1 3/2008 Je et al.
2009/0151758 A1 1/2009 Kristensson et al.
2009/0038657 A1* 2/2009 Kang ..... A47L 15/502 211/41.9
2010/0065468 A1 3/2010 Chiu et al.
2010/0319391 A1 12/2010 Lim et al.
2013/0300270 A1* 11/2013 Garnett ..... A47L 15/507 312/228.1
2017/0086646 A1* 3/2017 Kim ..... A47L 15/504

FOREIGN PATENT DOCUMENTS

DE 4401259 A1 * 7/1995 ..... A47L 15/504
FR 2043321 A7 * 2/1971 ..... A47L 15/505
KR 19980033531 U * 9/1998

(Continued)

OTHER PUBLICATIONS

Supplementary European Search Report (Year: 2021).*

(Continued)

*Primary Examiner* — Joseph L. Perrin
*Assistant Examiner* — Irina Graf
(74) *Attorney, Agent, or Firm* — Staas & Halsey LLP

(57) ABSTRACT

A dish washer includes: a main body; a tub positioned in the inside of the main body, wherein an object that is to be washed is washed in the tub; and an accommodating container positioned in the inside of the tub and accommodating the object that is to be washed, wherein the accommodating container includes: a frame forming an accommodating space in which the object that is to be washed is accommodated; and a shaft rotatably supporting a roller configured to move the accommodating container, wherein both ends of the shaft are supported on the frame.

19 Claims, 10 Drawing Sheets

(56) References Cited

FOREIGN PATENT DOCUMENTS

| | | | |
|---|---|---|---|
| KR | 10-2007-0015713 | 2/2007 | |
| KR | 10-2017-0037181 | 4/2017 | |
| WO | WO-9824357 A1 * | 6/1998 | ..... A47L 15/507 |

OTHER PUBLICATIONS

International Search Report dated Oct. 23, 2019 in International Patent Application No. PCT/KR2019/007857.
Supplementary European Search Report for European Application No. 19 84 7312 dated Jun. 6, 2021.

* cited by examiner

DISH WASHER WITH LOADING FRAME

CROSS-REFERENCE TO RELATED APPLICATIONS

This application is based on and claims priority under 35 U.S.C. § 119 to Korean Patent Application No. 10-2018-0091839, filed on Aug. 7, 2018 in the Korean Intellectual Property Office, the disclosure of which is incorporated by reference herein in its entirety.

BACKGROUND

1. Field

The disclosure relates to a dish washer, and more particularly, to a dish washer with an improved rack assembly structure.

2. Description of the Related Art

A dish washer is a machine that automatically washes off food residues remaining on dishes with a detergent and water.

The dish washer includes a main body, a tub positioned in the inside of the main body, an accommodating container positioned in the inside of the tub and accommodating dishes, and a spray unit for spraying water towards the accommodating container.

The accommodating container includes a basket in which dishes of relatively large volumes are accommodated, and a rack assembly in which dishes of relatively small volumes, such as cutlery, are accommodated.

The accommodating container includes moving elements for taking the accommodating container out of the tub. The moving elements include rollers rolling along guide rails installed on the tub.

In general, the accommodating container applies a large load to the rollers due to its own weight and the weight of dishes accommodated therein. When the rollers deteriorate due to the repeated applications of load, the rollers may be broken or deformed, which causes a user's inconvenience in using the dish accommodating assembly.

SUMMARY

Therefore, it is an aspect of the disclosure to provide a dish washer with an improved structure to enable a user to easily take/put an accommodating container out of/into a tub.

It is an aspect of the disclosure to provide a dish washer capable of efficiently supporting a load of an accommodating container.

It is an aspect of the disclosure to provide a dish washer capable of improving spatial efficiency.

It is an aspect of the disclosure to provide a dish washer having an accommodating container with improved durability.

Additional aspects of the disclosure will be set forth in part in the description which follows and, in part, will be obvious from the description, or may be learned by practice of the disclosure.

In accordance with an aspect of the disclosure, a dish washer includes: a main body; a tub positioned in the inside of the main body, wherein an object that is to be washed is washed in the tub; and an accommodating container positioned in the inside of the tub and accommodating the object that is to be washed, wherein the accommodating container includes: a loading frame including a loader on which the object that is to be washed is placed; a roller frame extending from the loading frame and configured to form an arrangement space together with the loading frame; and a shaft supporting a roller configured to move the loading frame such that the roller is rotatable in the arrangement space, wherein a first end and a second end of the shaft are respectively supported on the loading frame and the roller frame, the second end being opposite to the first end.

The roller frame may include: a support frame on which the second end of the shaft is supported; and an extension frame connecting the support frame to the loading frame.

The extension frame may be spaced from the shaft in a direction in which the accommodating container is taken out of or put into the tub.

The extension frame may be inclined towards the second end of the shaft from the loading frame.

The extension frame may connect both sides of the support frame with the loading frame, and the arrangement space may be defined by the extension frame, the support frame, and the loading frame.

The arrangement space may open vertically toward the tub.

The shaft may include a catching groove formed concavely in the outer surface, and the accommodating container may include a catching protrusion inserted in the catching groove and configured to limit axial movements of the shaft.

The loading frame may include a first insertion hole in which the first end of the shaft is inserted, and the support frame may include a second insertion hole in which the second end of the shaft is inserted.

The catching protrusion may be adjacent to at least one of the first insertion hole or the second insertion hole.

The first end and the second end of the shaft may be respectively fixed at the loading frame and the roller frame.

The loading frame and the roller frame may be injection-molded into one body.

The loading frame may include: a first support surface supporting an upper surface of the first end of the shaft; and a second support surface supporting a lower surface of the first end of the shaft and positioned closer to the second end of the shaft than the first support surface.

The loading frame may further include: an insertion hole in which one end of the shaft is inserted; and a guide surface formed at both sides of the second support surface and configured to guide the shaft to be inserted into the insertion hole.

The dish washer may further include a guide rail on which the roller is movable, wherein the roller may include: an upper roller positioned on the guide rail; and a lower roller positioned under the guide rail and located behind the upper roller.

Both sides of the roller may face an inner surface of the loading frame and an inner surface of the support frame, respectively, in an axial direction of the shaft.

The roller frame may protrude in a direction that is perpendicular to a moving direction of the loading frame.

In accordance with an aspect of the disclosure, a dish washer includes: a main body; a tub positioned in the inside of the main body, wherein an object that is to be washed is washed in the tub; and an accommodating container positioned in the inside of the tub, and accommodating the object that is to be washed, wherein the accommodating container may include: a loading frame including a loader on which the object that is to be washed is accommodated; a roller configured to be rotatable and to take the loading frame out of the tub; a shaft rotatably supporting the roller, wherein a first end of the shaft is supported on the loading frame; and a roller frame extending from the loading frame to form an arrangement space in which the roller and the shaft are arranged, and supporting a second end of the shaft, the second end being opposite to the first end.

The arrangement space may open from above and below toward the tub.

In accordance with an aspect of the disclosure, a dish washer includes: a main body; a tub positioned in the inside of the main body, wherein an object that is to be washed is washed in the tub; an accommodating container positioned in the inside of the tub and accommodating the object that is to be washed; a loading frame forming an accommodating space; a roller frame extending from the loading frame and forming an arrangement space together with the loading frame, wherein a roller configured to move the accommodating container is arranged in the arrangement space; and a shaft rotatably supporting the roller; wherein a first end and a second end of the shaft are respectively supported on the loading frame and the roller frame, the second end being opposite to the first end, wherein the roller frame includes: a support frame on which the second end of the shaft is supported; and an extension frame connecting the support frame with the loading frame, wherein the arrangement space opens vertically.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
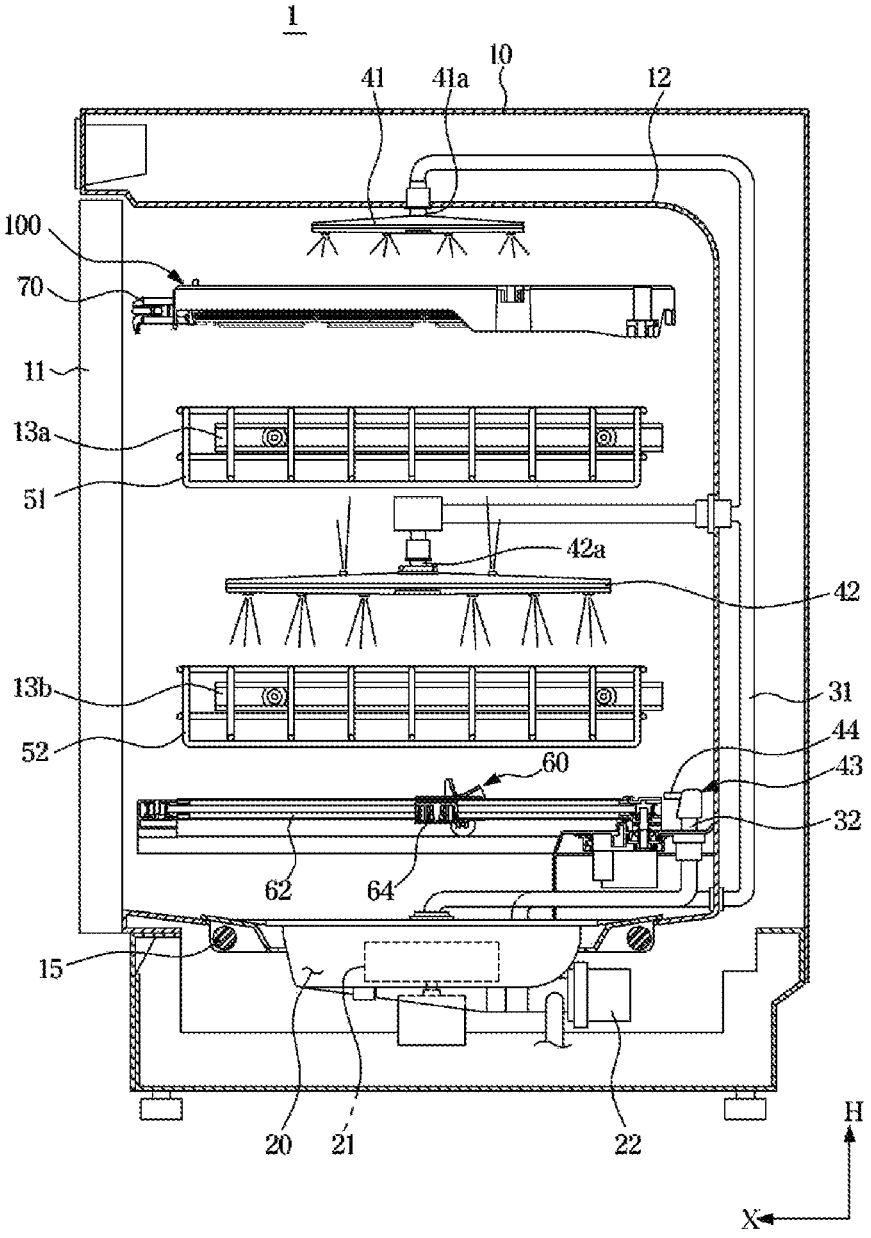
FIG. 1 is a cross-sectional view of a dish washer according to an embodiment of the disclosure.

Configurations illustrated in the embodiments and the drawings described in the present specification are only embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are merely used to describe particular embodiments, and are not intended to limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms "first," "second," etc. may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

Hereinafter, embodiments of the disclosure will be described in detail with reference to the accompanying drawings.

Figure 2:
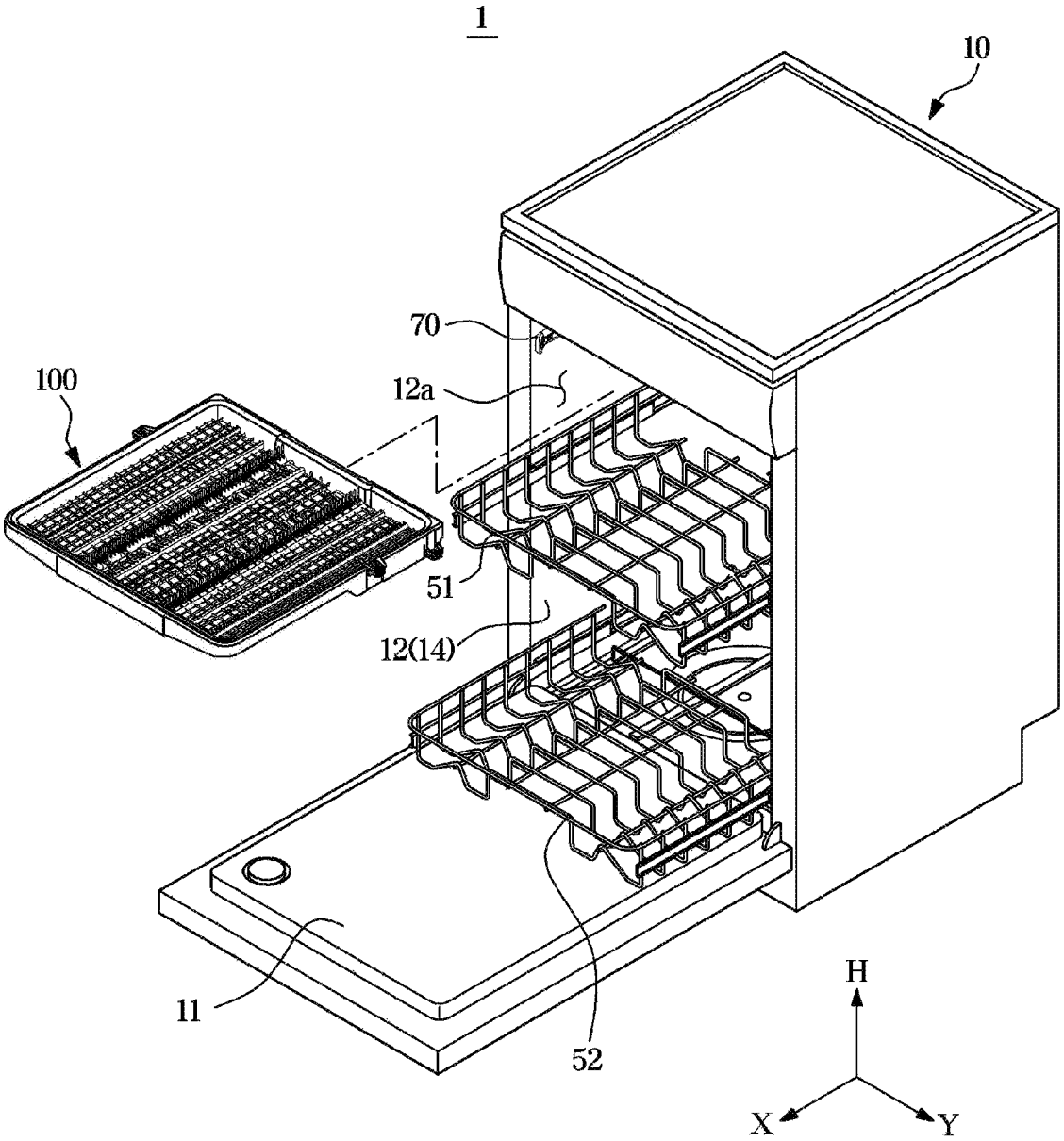
FIG. 2 is a perspective view of a dish washer according to an embodiment of the disclosure when a door of the dish washer opens.

FIG. 1 is a cross-sectional view of a dish washer according to an embodiment of the disclosure, and FIG. 2 is a perspective view of a dish washer according to an embodiment of the disclosure when a door of the dish washer opens.

A dish washer 1 may include a tub 12 positioned in the inside of a main body 10. The tub 12 may be in the shape of a box. One side of the tub 12 may open. That is, the tub 12 may be an opening 12*a*. For example, a front side of the tub 12 may open.

The dish washer 1 may further include a door 11 configured to open or close the opening 12*a* of the tub 12. The door 11 may be installed on the main body 10 to open or close the opening 12*a* of the tub 12. The door 11 may be rotatably installed on the main body 10.

The dish washer 1 may further include an accommodating container positioned in the inside of the tub 12 to accommodate dishes or objects that are to be washed.

The accommodating container may include a plurality of baskets 51 and 52. In the plurality of baskets 51 and 52, dishes of relatively large volumes may be accommodated. However, kinds of dishes that are accommodated in the plurality of baskets 51 and 52 are not limited to dishes of relatively large volumes. That is, dishes of relatively small volumes may also be accommodated in the plurality of baskets 51 and 52.

The plurality of baskets 51 and 52 may include an upper basket 51 positioned in a upper portion of the dish washer 1 in a height direction H of the dish washer 1, and a lower basket 52 positioned in a lower portion of the dish washer 1 in the height direction H of the dish washer 1. The upper basket 51 may be supported on an upper guide rack 13*a*, and the lower basket 52 may be supported on a lower guide rack 13*b*. The upper guide rack 13*a* and the lower guide rack 13*b* may be installed on an inner wall 14 of the tub 12 to be slidable toward the opening 12*a* of the tub 12. The inner wall 14 of the tub 12 may include an inner surface of a right wall of the tub 12 and an inner surface of a left wall of the tub 12.

The accommodating container may include a rack assembly 100. The rack assembly 100 may be positioned in the inside of the tub 12 to accommodate dishes therein. More specifically, the rack assembly 100 may be positioned in the inside of the tub 12 to be put into the tub 12 or to be taken out of the tub 12. More specifically, the rack assembly 100 may accommodate dishes of relatively small volumes therein. Also, kitchen tools, such as ladles, knifes, and spatulas, or cutlery may be accommodated in the rack assembly 100. Also, small cups such as espresso cups may be accommodated in the rack assembly 100. However, kinds of dishes that are accommodated in the rack assembly 100 are not limited to the above-mentioned examples. The rack assembly 100 may be positioned above the plurality of baskets 51 and 52 in the height direction H of the dish washer 1. In other words, the rack assembly 100 may be positioned near a top of the tub 12 in the height direction H of the dish washer 1. As kinds of the accommodating container, the plurality of baskets 51 and the rack assembly 100 have been described, and also, as objects that are accommodated in the accommodating container, dishes or cutlery have been described. However, any object that is to be washed may be accommodated in the accommodating container.

The dish washer 1 may further include a guide rail 70 installed on the inner wall 14 of the tub 12 to guide movements of the accommodating container. The rack assembly 100 may be movable along the guide rail 70. More specifically, the guide rail 70 may be installed on the inner wall 14 of the tub 12 to guide movements of the rack assembly 100. In the current embodiment of the disclosure, the guide rail 70 may guide movements of the rack assembly 100, although not limited thereto. The guide rail 70 may be installed on the inner wall 14 of the tub 12, instead of the upper guide rack 13*a* and the lower guide rack 13*b*, to guide movements of the plurality of baskets 51 and 52. Details about the guide rail 70 will be described later.

The dish washer 1 may further include a sump 20 configured to collect water and store it. In the sump 20, a washing pump 21 for pumping the stored water to a spray unit may be installed. The water pumped by the washing pump 70 may be supplied to a first spray unit 41 and a second spray unit 42 which will be described later, through a first supply pipe 31, or the water may be supplied to a third spray unit 43 which will be described later, through a second supply pipe 32.

The dish washer 1 may further include a heater 15 positioned below the tub 12 to heat water, and a drain pump 22 positioned below the tub 12 to drain water.

The dish washer 1 may further include a plurality of spray units 41, 42, and 43 configured to spray water. The spray units 41, 42, and 43 may include a first spray unit 41 positioned above the upper basket 51 in the height direction H of the dish washer 1, a second spray unit 42 positioned between the upper basket 51 and the lower basket 52 in the height direction H of the dish washer 1, and a third spray unit 43 positioned below the lower basket 52 in the height direction H of the dish washer 1. More specifically, the first spray unit 41 may be positioned above the rack assembly 100 in the height direction H of the dish washer 1.

The first spray unit 41 may be rotatable on a rotation shaft 41*a*, and the second spray unit 42 may be rotatable on a rotation shaft 42*a*.

The first spray unit 41 may spray water toward dishes accommodated in the rack assembly 100 and the upper basket 51, and the second spray unit 42 may spray water toward dishes accommodated in the upper basket 51 and the lower basket 52.

The third spray unit 43 may be fixed on one wall of the tub 12, unlike the first spray unit 41 and the second spray unit 42. The third spray unit 43 may spray water in a substantially horizontal direction, and accordingly, water sprayed by the third spray unit 43 may be not directed directly to the dishes.

The third spray unit 43 may include a plurality of nozzles 44 through which water is sprayed. The nozzles 44 may be arranged at predetermined intervals in a row from one wall of the tub 12 to the opposite wall of the tub 12.

Water sprayed in the substantially horizontal direction from the nozzles 44 of the third spray unit 43 may change direction by a switching assembly 60 positioned in the inside of the tub 12 to be directed toward dishes accommodated in the lower basket 52. The switching assembly 60 may be supported on a guide rail 62 by a holder 64 in such a way to be movable along the guide rail 62.

Figure 3:
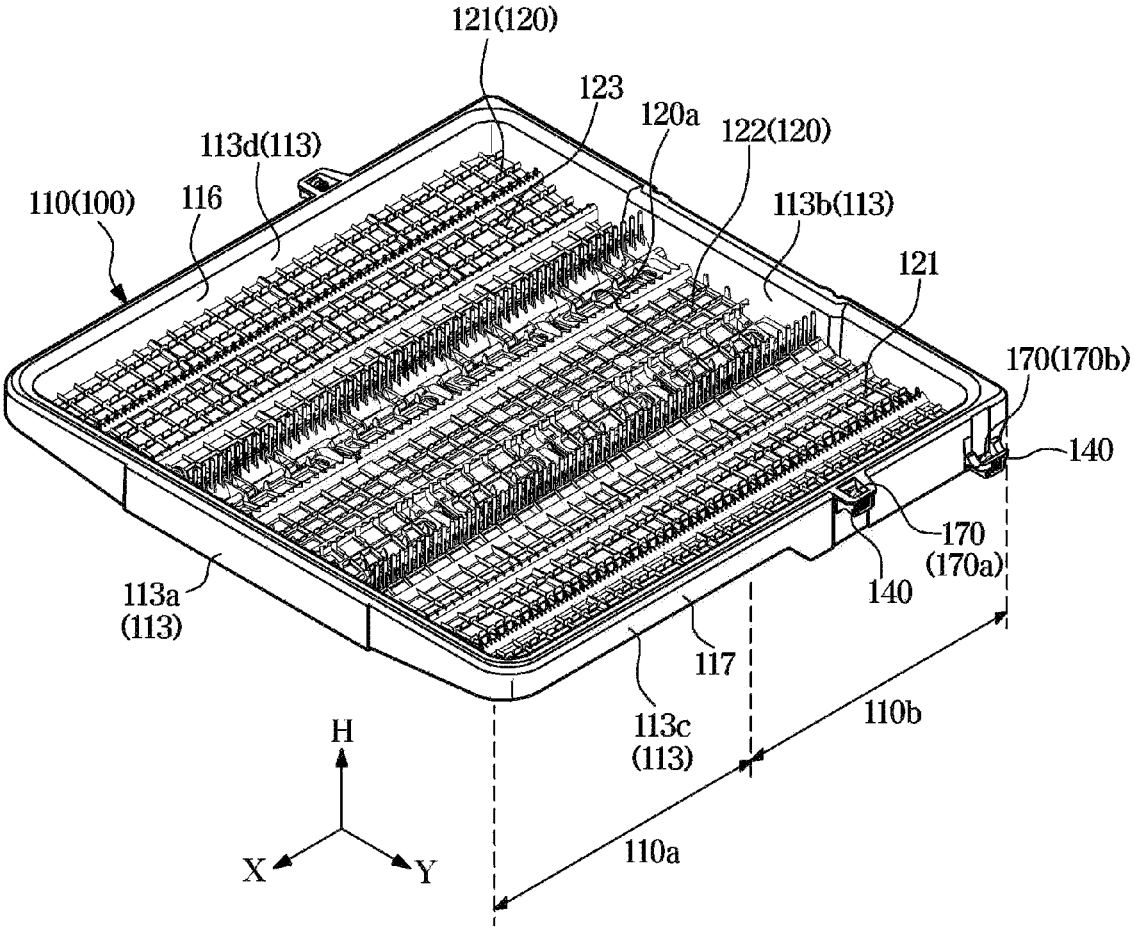
FIG. 3 is a perspective view of an accommodating container of a dish washer according to an embodiment of the disclosure.
Figure 4:
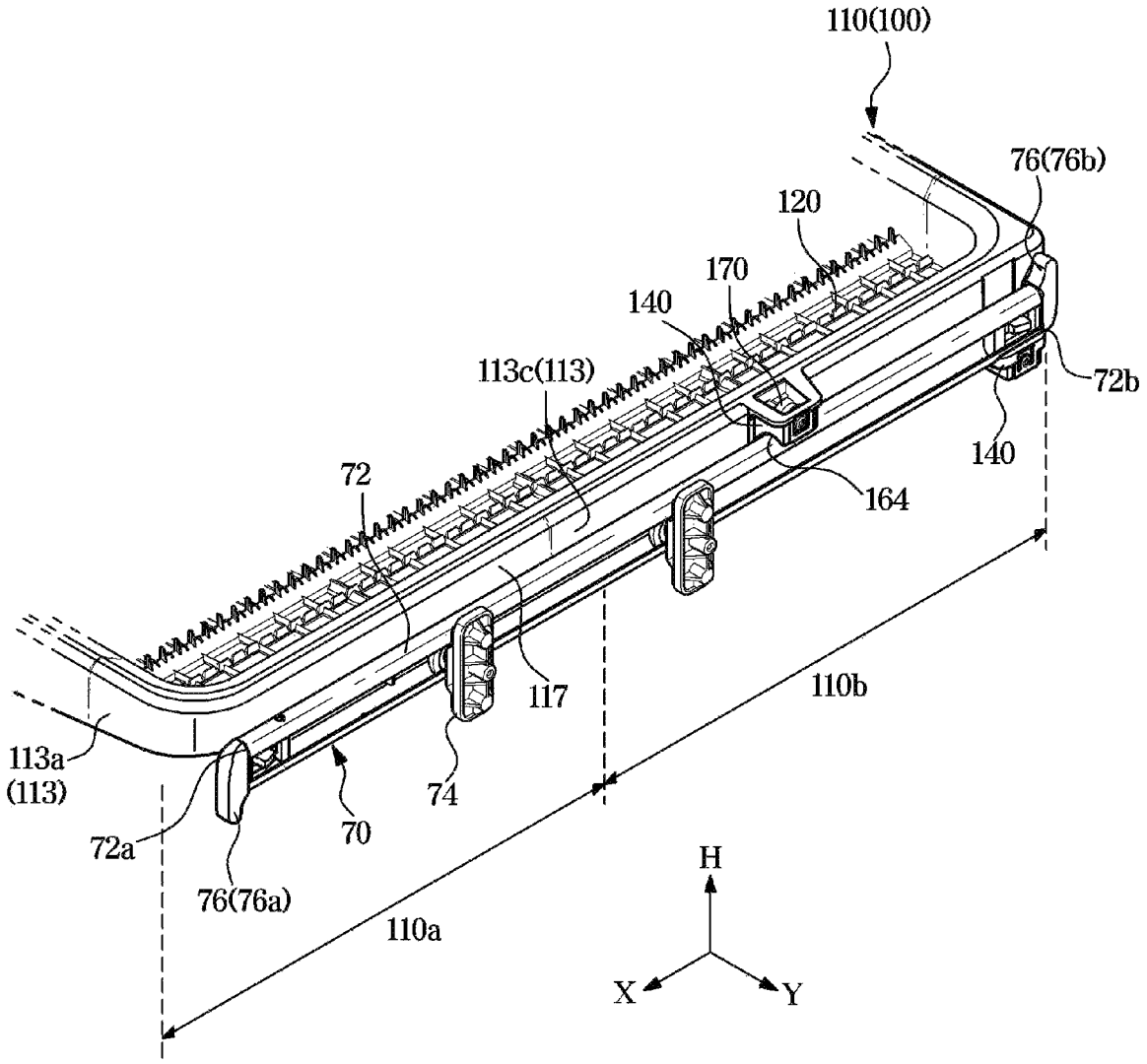
FIGS. 4 and 5 show an accommodating container and a guide rail of a dish washer according to an embodiment of the disclosure.
Figure 5:
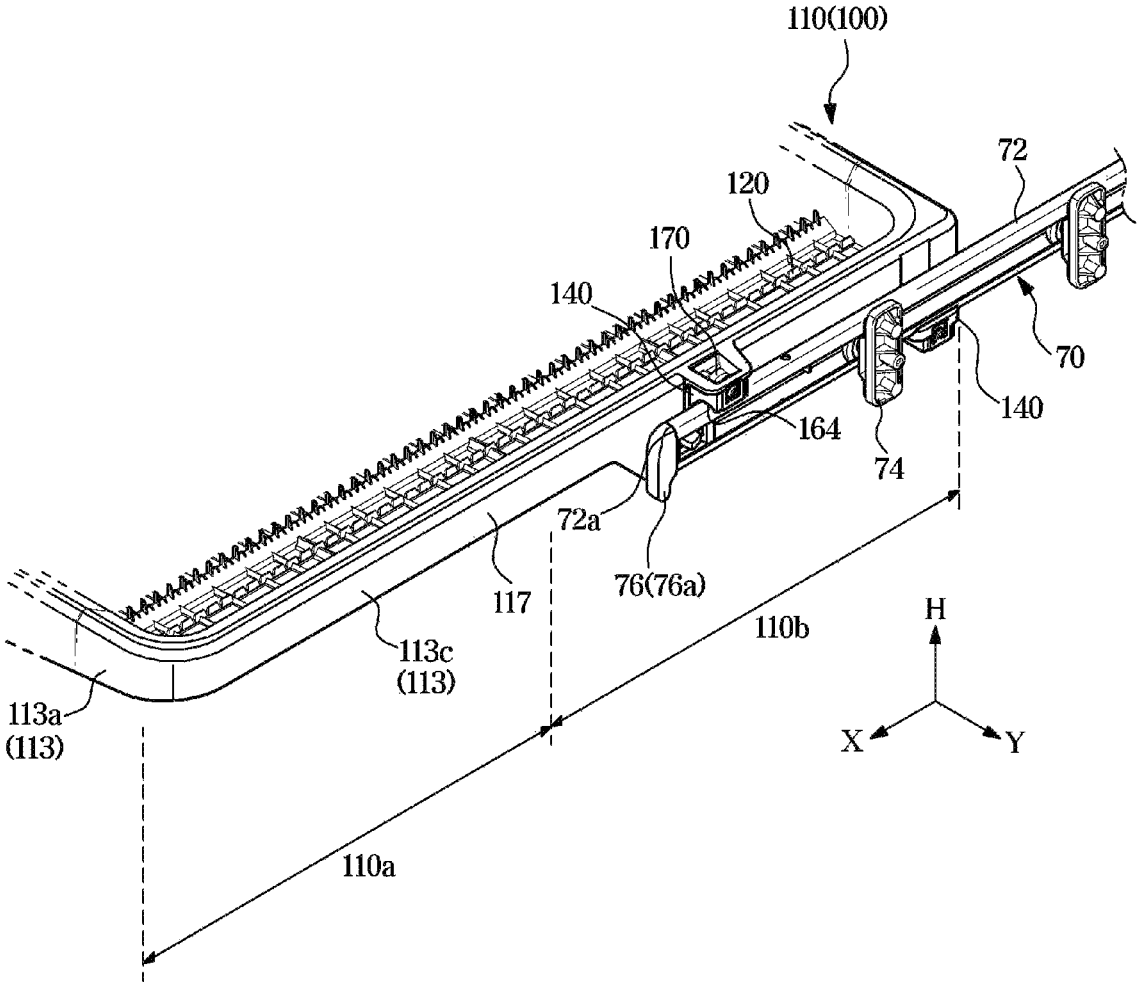

FIG. 3 is a perspective view of an accommodating container of a dish washer according to an embodiment of the disclosure, and FIGS. 4 and 5 show an accommodating container and a guide rail of a dish washer according to an embodiment of the disclosure.

The accommodating container may include the baskets 51 and 52 and/or the rack assembly 100. In the current embodiment of the disclosure, the rack assembly 100 will be mainly shown and described, however, the following descriptions may be applied to any accommodating container that may be accommodated in the dish washer 1.

The rack assembly 100 may include a frame forming the outer appearance.

The frame may include a loading frame 110, and a roller frame 140 formed in the loading frame 110.

The loading frame 110 may include a loader 120 on which dishes are placed. The loader 120 may form an accommodating space 120*a*. The loader 120 may include a fixed plate 121, and an elevating plate 122 that is elevatable with respect to the fixed plate 121. A height of the elevating plate 122 may be adjustable. The elevating plate 122 may be positioned in a center of the loading frame 110 to be elevatable. Dishes may be placed on the fixed plate 121 and the elevating plate 122.

In the loader 120, a plurality of holes 123 may be formed to pass water through the loader 120. However, the loader 120 is not limited to a shape shown in FIG. 3, and may be in another shape. For example, the loader 120 may be formed in the shape of a lattice extending in horizontal and vertical directions, or a plurality of protrusions for supporting dishes may be formed on the loader 120 so that the dishes stand on the protrusions. That is, the loader 120 is not limited as long as it supports dishes and includes holes for passing water.

The loading frame 110 may further include a wall 113 having a predetermined height in the height direction H of the dish washer 1 and extending along a circumference of the loader 120. The wall 113 of the loading frame 110 may include a first wall 113*a* facing the opening 12*a* of the tub 12, a second wall 113*b* being opposite to the first wall 113*a*, and a third wall 113*c* and a fourth wall 113*d* connecting the first wall 113*a* with the second wall 113*b*. For example, the first wall 113*a* of the loading frame 110 may face a front portion of the tub 12, and the second wall 113*b* of the loading frame 110 may face a rear portion of the tub 12. The third wall 113*c* and the fourth wall 113*d* of the loading frame 110 may face a right portion and a left portion of the tub 12, respectively.

The wall 113 of the loading frame 110 may be formed in a double-wall structure. More specifically, the wall 113 of the loading frame 110 may include an inner wall 116 that is adjacent to the loader 120, and an outer wall 117 positioned in the outside of the inner wall 116. The outer wall 117 may be spaced from the inner wall 116. The inner wall 116 of the loading frame 110 may define edges of the loader 120. In other words, the inner wall 116 of the loading frame 110 may define edges of the fixed plate 121.

The guide rail 70 may include a rail body 72. The rail body 72 may be fixed on the inner wall 14 of the tub 12. More specifically, the rail body 72 may be fixed on the inner wall 14 of the tub 12 by a coupling member (not shown) through a mounting member 74. The coupling member (not shown) may be a screw. The rail body 72 may include a first end 72*a* facing the opening 12*a*, and a second end 72*b* that is opposite to the first end 72*a*. In other words, the first end 72*a* of the rail body 72 may face the front portion of the dish washer 1, and the second end 72*b* of the rail body 72 may face the rear portion of the dish washer 1.

The guide rail 70 may include a rail holder 76 coupled with the rail body 72. The rail holder 76 may include a first rail holder 76*a* coupled with the first end 72*a* of the rail body 72, and a second rail holder 76*b* coupled with the second end 72*b* of the rail body 72.

The first rail holder 76*a* and the second rail holder 76*b* may extend in different directions. More specifically, the first rail holder 76*a* may extend downward, and the second rail holder 76*b* may extend upward. In other words, the first rail holder 76*a* may be bent downward, and the second rail holder 76*b* may be bent upward. However, directions in which the first rail holder 76*a* and the second rail holder 76*b* extend or are bent are not limited to the above example. That is, the first rail holder 76*a* and the second rail holder 76*b* may extend or be bent in the same direction.

The rack assembly 100 may include a first portion 110*a* positioned toward the opening 12*a*, and a second portion 110*b* that is opposite to the first portion 110*a*. In other words, the rack assembly 100 may include the first portion 110*a* positioned toward the front portion of the dish washer 1 and the second portion 110*b* positioned toward the rear portion of the dish washer 1. At least one roller 170 may be positioned in the second portion 110*b* of the rack assembly 100. More specifically, the at least one roller 170 may be installed on a wall of the loading frame 110 corresponding to the second portion 110*b* of the rack assembly 100.

A pulling out movement of the rack assembly 100 from the tub 12 may be limited by the first rail holder 76*a*. That is, the rack assembly 100 may be taken out from the tub 12 until the first rail holder 76*a* provides a limiting interference.

When the rack assembly 100 has been taken out from the tub 12, the first portion 110*a* of the rack assembly 100 may be in a free state, as shown in FIG. 5. That is, when the rack assembly 100 has been taken out from the tub 12, the first portion 110*a* of the rack assembly 100 may become a free state in which the first portion 110*a* is not supported by the guide rail 70. When the rack assembly 100 has been taken out from the tub 12, the second portion 110*b* of the rack assembly 100 may be supported on the guide rail 70 by the at least one roller 170.

Figure 6:
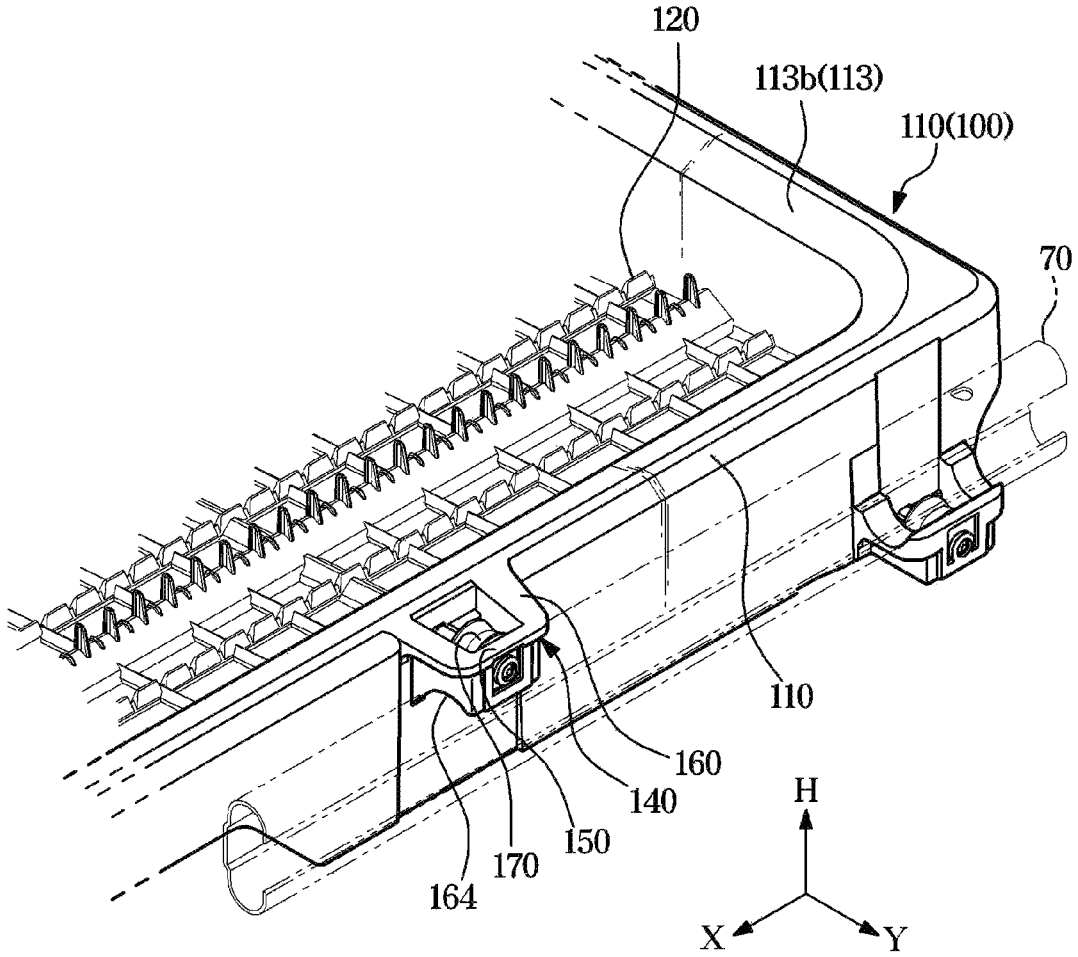
FIG. 6 is an enlarged view showing a part of an accommodating container of a dish washer according to an embodiment of the disclosure.
Figure 7:
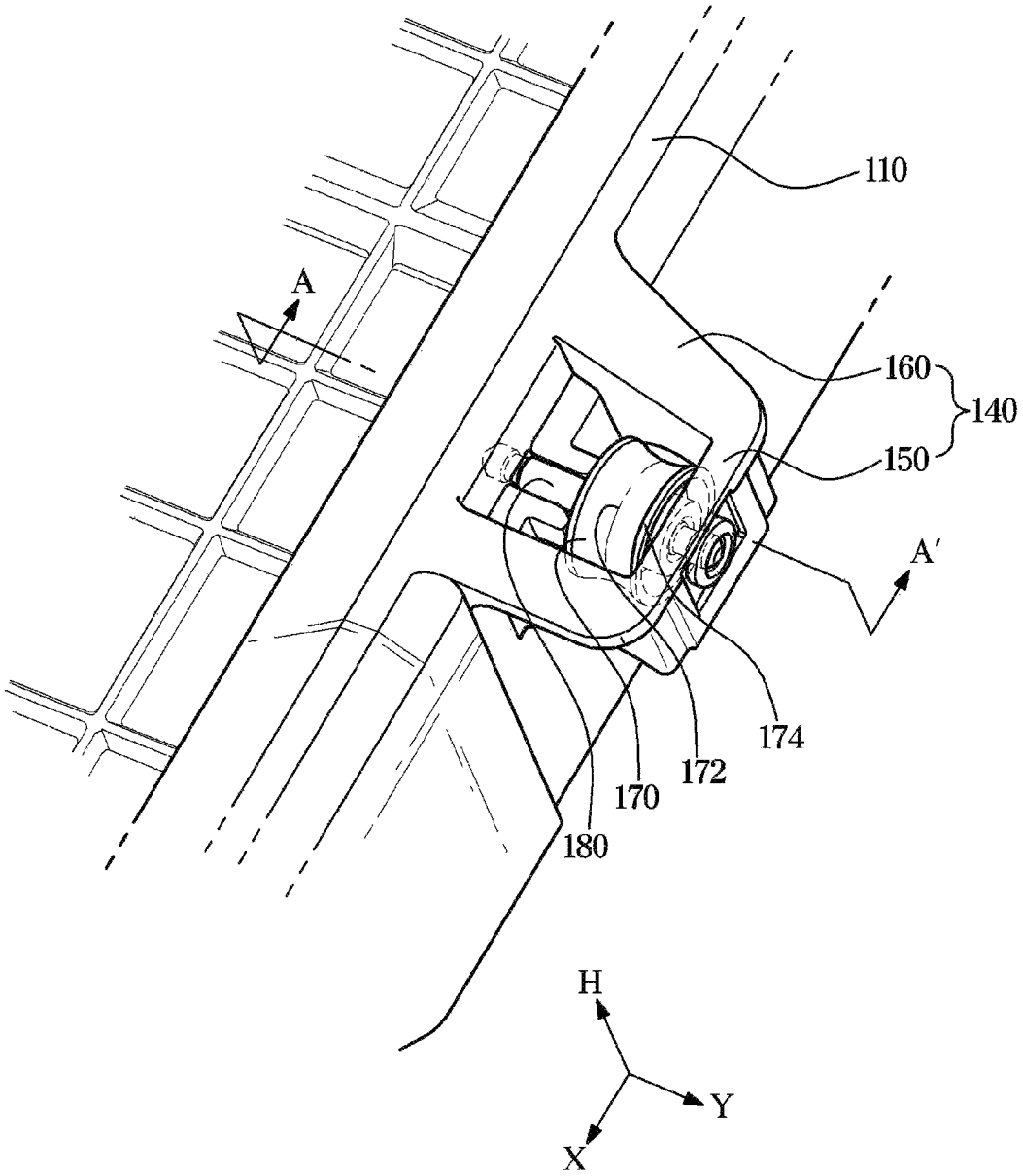
FIG. 7 is an enlarged view showing some components of an accommodating container of a dish washer according to an embodiment of the disclosure.
Figure 8:
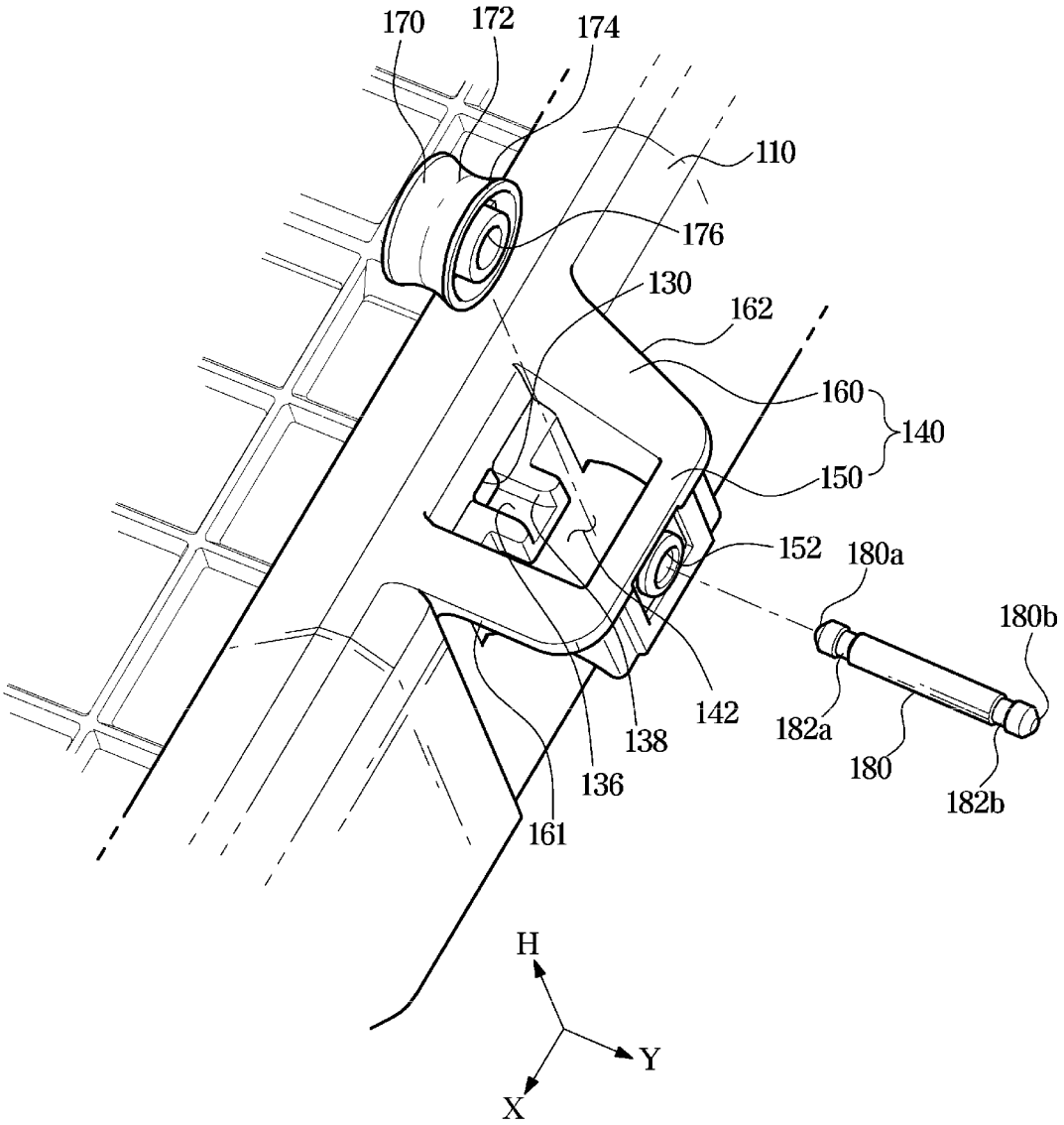
FIG. 8 is an exploded perspective view of some components of an accommodating container of a dish washer according to an embodiment of the disclosure.

FIG. 6 is an enlarged view showing a part of an accommodating container of a dish washer according to an embodiment of the disclosure, FIG. 7 is an enlarged view showing some components of an accommodating container of a dish washer according to an embodiment of the disclosure, and FIG. 8 is an exploded perspective view of some components of an accommodating container of a dish washer according to an embodiment of the disclosure.

The frame may include the roller frame 140.

The roller frame 140 may support a shaft 180. One end of the shaft 180 may be supported on the loading frame 110, and the other end of the shaft 180 may be supported on the roller frame 140.

The roller frame 140 may be positioned on a side portion of the loading frame 110. More specifically, the roller frame 140 may extend from the third and fourth walls 113*c* and 113*d* of the loading frame 110. The roller frame 140 may protrude from the loading frame 110 in a direction that is perpendicular to a moving direction of the loading frame 110. Because the roller frame 140 is positioned at both sides of the loading frame 110, a vertical height H of the rack assembly 110 may be reduced, and the rack assembly 110 may be easily put into the tub 12.

The roller frame 140 may include a support frame 150 and an extension frame 160. The roller frame 140 may be formed in approximately a "⊏" shape. That is, the roller frame 140 may extend in a "⊏" shape from the loading frame 110 to form an arrangement space 142 together with the loading frame 110.

The support frame 150 may support a second end 180*b* of the shaft 180.

The support frame 150 may be spaced from the loading frame 110. The support frame 150 may be spaced from the loading frame 110 by a distance that is greater than an axial thickness of the roller 170.

The loading frame 110 may include a first insertion hole 130 in which a first end 180*a* of the shaft 180 is inserted, and the support frame 150 may include a second insertion hole 152 in which the second end 180*b* being the other end of the shaft 180 is inserted. When the shaft 180 is positioned in the roller frame 140, the first end 180*a* and the second end 180*b* of the shaft 180 may be positioned in the first insertion hole 130 and the second insertion hole 152, respectively. The shaft 180 may be inserted into the first insertion hole 130 and the second insertion hole 152, so that both ends of the shaft 180 may be supported by the loading frame 110 and the support frame 150, respectively.

By locating the roller 170 in the arrangement space 142 and inserting the shaft 180 into a cavity 176 of the roller 170, the first insertion hole 130 of the loading frame 110, and the second insertion hole 152 of the support frame 150, the shaft 180 and the roller 170 may be installed in the rack assembly 100.

Figure 9:
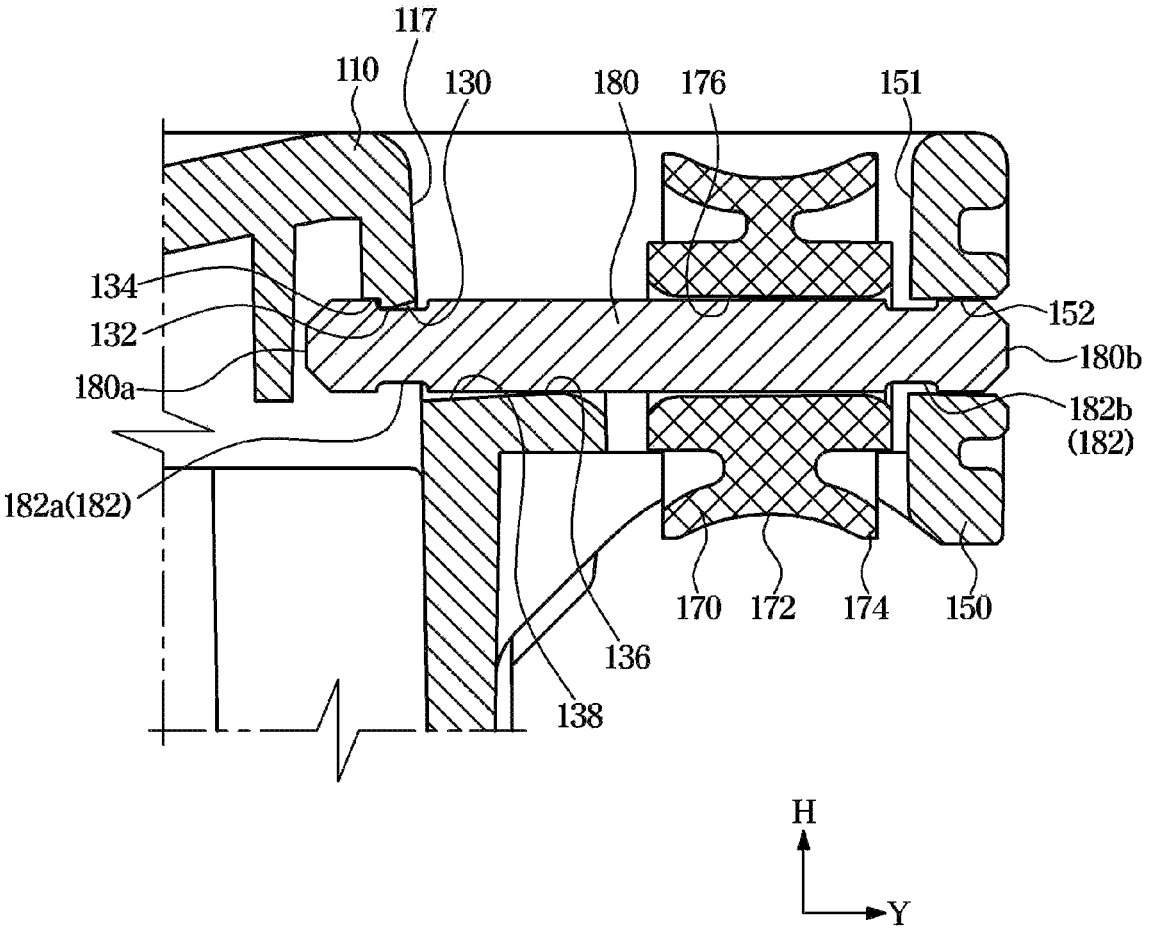
FIG. 9 is a cross-sectional view taken along line A-A' of FIG. 7.

Both sides of the roller 170 may face the outer wall 117 of the loading frame 110 and an inner wall 151 of the support frame 150, respectively, as shown in FIG. 9. Also, an upper portion of the roller 170 may be lower than or equal to an upper portion of the roller frame 140, and a lower portion of the roller 170 may be higher than or equal to a lower portion of the roller frame 140. More specifically, an upper portion of the roller 170 may be lower than or equal to an upper portion of the support frame 150, and a lower portion of the roller 170 may be higher than or equal to a lower portion of the support frame 150. Also, a size of one side of the roller 170 may be smaller than that of the inner wall 151 of the support frame 150 which the side of the roller 170 faces. Through the configuration, both sides of the roller 170 may be not exposed in an axial direction by the loading frame 110 and the support frame 150 so that the roller 170 may be prevented from being broken by an external force applied during a washing process or upon moving the rack assembly 100.

Although not shown in the current embodiment of the disclosure, the support frame 150 may include a frame cover (not shown) for covering the second insertion hole 152. The frame cover may cover the second insertion hole 152 to prevent the second insertion hole 152 from being exposed.

The roller frame 140 may include the extension frame 160.

The extension frame 160 may connect the support frame 150 with the loading frame 110. The extension frame 160 may extend from the loading frame 110. The support frame 150 and the extension frame 160 may extend from the loading frame 110. The loading frame 110 and the roller frame 140 may be integrated into one body.

The extension frame 160 may fix the support frame 150 at the loading frame 110. The extension frame 160 may connect one side of the support frame 150 with the loading frame 110. In the current embodiment of the disclosure, the extension frame 160 may connect both sides of the support frame 150 with the loading frame 110.

The extension frame 160 may form the arrangement space 142 together with the support frame 150 and the loading frame 110. That is, the loading frame 110 and the roller frame 140 may form the arrangement space 142 therebetween. In the current embodiment of the disclosure, the arrangement space 142 may be formed by a pair of extension frames 160, the support frame 150 and the loading frame 110. In the arrangement space 142, the roller 170 and the shaft 180 may be arranged. The arrangement space 142 may be formed by the loading frame 110 and the roller frame 140, and the arrangement space 142 may open vertically. That is, the roller 170 and the shaft 180 may open from above and below. The open structure of the arrangement space 142 may prevent water remaining in the tub 12 from being collected in the arrangement space 142. Also, the open structure of the arrangement space 142 may prevent foreign materials removed from dishes in a dish washing process from being collected in the arrangement space 142.

To form the arrangement space 142, the extension frames 160 may be spaced from the shaft 180 in the direction in which the rack assembly 100 is taken out of or put into the tub 12. The extension frames 160 may be spaced from the shaft 180 to form a space in which the roller 170 may be positioned, and also to function to protect the shaft 180 and the roller 170 from an external force.

When the roller 170 rests on the guide rail 70, a load may be applied on the roller 170 by a weight of dishes and the rack assembly 100. The load applied on the roller 170 may be dispersed to both ends of the shaft 180. Weight applied on the second end 180*b* of the shaft 180 may be dispersed by the support frame 150 and the extension frames 160.

The extension frames 160 may extend from the loading frame 110 and be inclined toward the second end 180*b* of the shaft 180. That is, the pair of extension frames 160 may be spaced from each other with a smaller interval at a longer distance from the loading frame 110. The extension frames 160 may function to efficiently disperse a load applied on the second end 180*b* of the shaft 180.

Outer surfaces of the extension frames 160 may be inclined. That is, the extension frames 160 may include first and second inclined surfaces 161 and 162. Therefore, an external force applied on the roller frame 140 when the rack assembly 100 is taken out of or put into the tub 12 may be efficiently dispersed. More specifically, when the rack assembly 100 is taken out of the tub 12, the first inclined surface 161 may disperse an external force, and when the rack assembly 100 is put into the tub 12, the second inclined surface 162 may disperse an external force.

Each extension frame 160 may include a recess 164 through which the guide rail 70 passes, wherein the recess 164 may be formed concavely. When the roller 170 contacts the guide rail 70, the extension frames 160 may interfere with the guide rail 170. The recess 164 may be formed in a concave shape corresponding to a shape of the guide rail 70 in the bodies of the extension frames 160 so that the extension frames 160 do not interfere with the guide rail 70.

The loading frame 110 and the roller frame 140 may be injection-molded.

The loading frame 110 and the roller frame 140 may be integrated into one body through injection-molding. The loading frame 110 and the roller frame 140 may be injection-molded with a plastic material. In this case, light weight and low manufacturing cost may be achieved compared with when the loading frame 110 and the roller frame 140 are made of a metal material. In addition, a process of coupling the frame and the roller 170 with a metal wire mold may be omitted, thereby simplifying a manufacturing process. Also, the accommodating container may be made of a plastic material, instead of a metal material, and therefore, the accommodating container may be manufactured with light weight and low cost.

FIG. 9 is a cross-sectional view taken along line A-A' of FIG. 7.

The rack assembly 100 may further include the roller 170 rotatably installed around the shaft 180. The roller 170 may be rotatably installed around the shaft 180 in such a way to be movable along the guide rail 70. That is, when the roller 170 rolls on the guide rail 70, the accommodating container may move along the guide rail 70.

The roller 170 may rotate with respect to the shaft 180 which will be described later. The roller 170 may include a cavity 176 for accommodating the shaft 180.

The roller 170 may include a rolling portion 172 and a flare 174. The rolling portion 172 may contact the guide rail 70. In the current embodiment of the disclosure, because a surface of the guide rail 70 which the rolling portion 172 contacts is a convex surface, the rolling portion 172 may have a concave surface.

The flare 174 may be formed at both sides of the rolling portion 172. A diameter of the flare 174 may be greater at a longer distance from the rolling portion 172. A diameter of the roller 170 may be a minimum at the rolling portion 172. A pair of flares 174 may be respectively provided on both sides of the rolling portion 172. Through the configuration, the roller 170 may be stably rested on the guide rail 70. Also, the configuration may prevent the roller 170 from escaping from the guide rail 70.

The shaft 180 may pass through the cavity 176 of the roller 170. The shaft 180 may form a rotation axis of the roller 170 and extend in a left-right direction Y.

The shaft 180 may be supported by the frame at both ends. When one end, rather than both ends, of the shaft 180 is fixed at the frame, a load or moment applied to the end of the shaft 180 may increase to accumulate a degree of fatigue on the shaft 180. For this reason, the shaft 180 or the roller 170 may be broken or deformed so that the roller 170 may not roll smoothly. Also, when one end of the shaft 180 is fixed at the frame, the shaft 180 may need to be designed to have a great diameter to withstand a load or moment applied on the shaft 180. A great diameter of the shaft 180 may relatively increase a size of the roller 170 so that a contact area between the shaft 180 and the roller 170 becomes widened, resulting in a deterioration of rolling efficiency.

In the current embodiment of the disclosure, both ends of the shaft 180 may be supported by or fixed at the loading frame 110 and the roller frame 140. Because the shaft 180 is supported at both ends, a reaction force applied to the roller 170 by weight of the rack assembly 100 or dishes may be dispersed to both ends of the shaft 180. Also, because a load or moment applied on the shaft 180 is dispersed to both ends of the shaft 180, it may be possible to further reduce the diameter of the shaft 180. Thereby, a wide choice in diameter or material of the roller 170 may offered. Also, as the diameter of the shaft 180 is reduced, an area of contact to the roller 170 may be reduced, which reduces friction, resulting in an improvement of rolling efficiency of the roller 170. The shaft 180 may be inserting-combined with the loading frame 110 and the support frame 150, or the shaft 180 may be fixed at the loading frame 110 and the support frame 15.

The shaft 180 may include a catching portion 182. The catching portion 182 may be formed concavely in the shaft 180. A catching protrusion which will be described later may be inserted into the catching portion 182 to prevent the shaft 180 from moving in the axial direction.

The catching portion 182 may include a first catching portion 182*a* and a second catching portion 182*b*. The first catching portion 182*a* may be formed in one end of the shaft 180 that is inserted in the loading frame 110, and the second catching portion 182*b* may be formed in the other end of the shaft 180 that is inserted in the support frame 150. The loading frame 110 may include a catching protrusion 132 to correspond to the first and second catching portions 182*a* and 182*b*.

When the shaft 180 is inserted into the first and second insertion holes 130 and 152, any one of the first and second catching portions 182*a* and 182*b* may be caught by the catching protrusion 132. The catching protrusion 132 may be adjacent to any one of the first and second insertion holes 130 and 152. In the current embodiment of the disclosure, the catching protrusion 132 may be adjacent to the first insertion hole 130, while being caught by any one of the first and second catching portions 182*a* and 182*b*. However, a pair of catching protrusions 132 may be adjacent to the first and second insertion holes 130 and 152, and the pair of catching protrusions 132 may be caught by the first and second catching portions 182*a* and 182*b*, respectively. Through the configuration, the shaft 180 may be prevented from escaping from the frame.

The loading frame 110 may include a first support surface 134 and a second support surface 136. The first support surface 134 may support an upper surface of the shaft 180. Also, the first support surface 134 may constitute a part of the first insertion hole 130. On the first support surface 134, the first catching protrusion 132 described above may be positioned. The second support surface 136 may support a lower surface of the shaft 180. The second support surface 136 may be closer to the roller 170 than the first support surface 134. The first and second support surfaces 134 and 136 may support one end of the shaft 180, and an area at which the first support surface 134 contacts the shaft 180 may be spaced in the axial direction of the shaft 180 from an area at which the second support surface 136 contacts the shaft 180. Through the configuration, a moment generated by a force applied to the roller 170 may be dispersed.

The loading frame 110 may include a guide surface 138 (see FIG. 8). When the shaft 180 is inserted into the loading frame 10, the guide surface 138 may guide the shaft 180 to be inserted into the first insertion hole 130. The guide surface 138 may be formed on the loading frame 110 at both sides of the second support surface 136.

Figure 10:
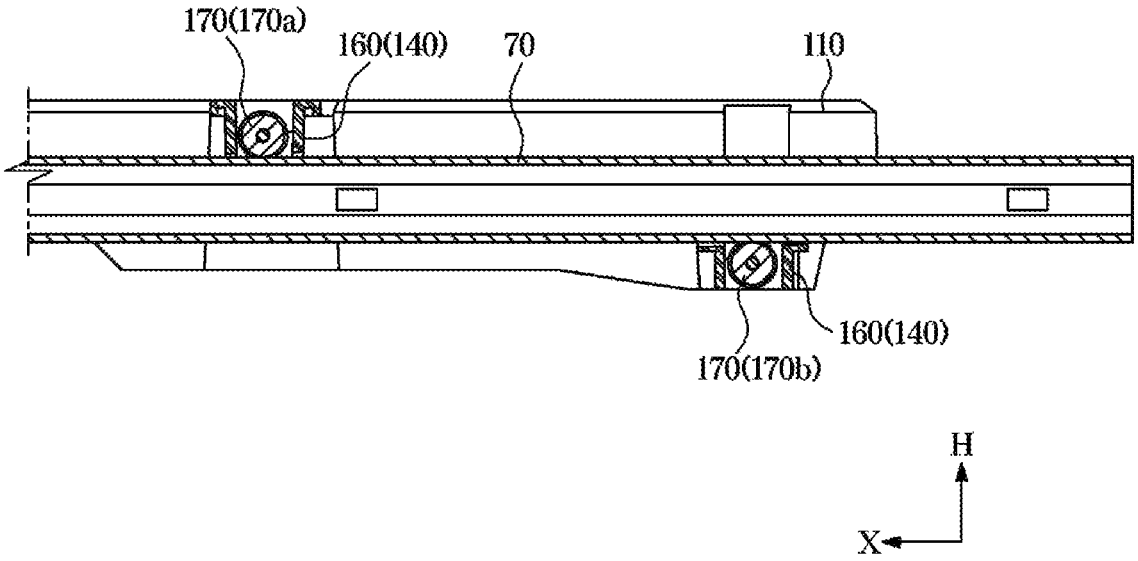
FIG. 10 is a side view of an accommodating container of a dish washer according to an embodiment of the disclosure.

FIG. 10 is a side view of an accommodating container of a dish washer according to an embodiment of the disclosure.

The roller frame 140 may be positioned at both sides of the loading frame 110. More specifically, the roller frame 140 may be positioned at the third and fourth walls 113*c* and 113*d* of the loading frame 110.

The roller 170 may include a first roller 170*a* and a second roller 170*b*. The first roller 170*a* may contact the upper surface of the guide rail 70, and the second roller 170*b* may contact the lower surface of the guide rail 70 and be positioned behind the first roller 170. When the rack assembly 100 is taken out of the tub 12 along the guide rail 70, a moment against the guide rail 70 may be generated by the weight of the rack assembly 100 and dishes. By installing the first and second rollers 170*a* and 170*b* spaced from each other along a longitudinal direction of the guide rail 70, a moment generated against the guide rail 70 may be dispersed.

According to an aspect of the disclosure, by improving the structure of the accommodating container, the accommodating container can be easily taken out of or put into the tub.

According to an aspect of the disclosure, the accommodating container can move smoothly.

According to an aspect of the disclosure, the size of the roller can be reduced, which makes better use of the inside space of the tub.

According to an aspect of the disclosure, foreign materials can be prevented from being collected around the roller, which improves the operation reliability of the roller.

According to an aspect of the disclosure, a wide choice in size and material of the roller can be offered so that the accommodating container can be stably supported.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A dish washer comprising:

a main body;

a tub positioned inside the main body and including an inner wall; and an accommodating container configured to be positioned inside the tub, wherein the accommodating container comprises:

a loading frame including a loader configured to support an object that is to be washed;

a roller frame formed to extend from an outer edge of a side of the loading frame toward the inner wall of the tub so that the roller frame together with the outer edge of the side of the loading frame defines an arrangement space, wherein an opening to the arrangement space is defined by an upper surface of the roller frame and an upper surface of the loading frame facing a top wall of the tub and is between the loading frame and the inner wall of the tub while the accommodating container is inside the tub;

a roller configured to be rotatable in the arrangement space to move the loading frame into and out of the tub; and a shaft configured to be accommodated in the arrangement space formed by the roller frame together with the loading frame and support the roller, wherein while the shaft is accommodated in the arrangement space, the shaft has a first end supported by the loading frame and a second end opposite to the first end supported by the roller frame, wherein the loading frame and the roller frame are provided to be movable relative to the tub together with the roller accommodated in the arrangement space.

2. The dish washer of claim 1, wherein the roller frame comprises:

a support frame on which the second end of the shaft is supported; and an extension frame to connect the support frame with the loading frame.

3. The dish washer of claim 2, wherein the extension frame is spaced apart from the shaft in a direction in which the loading frame is movable in the tub.

4. The dish washer of claim 3, wherein the extension frame is slanted towards the second end of the shaft from the loading frame.

5. The dish washer of claim 2, wherein the extension frame connects both sides of the support frame to the loading frame, and an outside perimeter of the arrangement space is defined by the extension frame, the support frame, and the loading frame.

6. The dish washer of claim 2, wherein the shaft comprises a catching groove formed concavely in an outer surface of the shaft, and the accommodating container comprises a catching protrusion inserted in the catching groove and configured to limit axial movements of the shaft.

7. The dish washer of claim 6, wherein the loading frame comprises a first insertion hole in which the first end of the shaft is inserted, and the support frame comprises a second insertion hole in which the second end of the shaft is inserted.

8. The dish washer of claim 7, wherein the catching protrusion is disposed adjacent to at least one of the first insertion hole or the second insertion hole.

9. The dish washer of claim 2, wherein opposite sides of the roller face an inner surface of the loading frame and an inner surface of the support frame, respectively, in an axial direction of the shaft.

10. The dish washer of claim 1, wherein the arrangement space is open along a vertical direction of the tub.

11. The dish washer of claim 1, wherein the first end and the second end of the shaft are respectively fixed in an axial direction of the shaft at the loading frame and the roller frame.

12. The dish washer of claim 1, wherein the loading frame and the roller frame are injection-molded into one body.

13. The dish washer of claim 1, wherein the loading frame comprises:

a first support surface to support an upper surface of the first end of the shaft; and a second support surface to support a lower surface of the first end of the shaft and positioned closer to the second end of the shaft than the first support surface.

14. The dish washer of claim 13, wherein the loading frame further comprises:

an insertion hole in which the first end of the shaft is inserted; and a guide surface formed at both sides of the second support surface and configured to guide the shaft to be inserted into the insertion hole.

15. The dish washer of claim 1, further comprising a guide rail on which the roller is movable, wherein the roller comprises:

an upper roller positioned on the guide rail; and a lower roller positioned under the guide rail and located further to a rear of the tub than the upper roller.

16. The dish washer of claim 1, wherein the roller frame extends from the loading frame in a direction that is perpendicular to a direction in which the loading frame is movable in the tub.

17. A dish washer comprising:

a main body;

a tub positioned inside the main body; and an accommodating container configured to be positioned inside the tub, wherein the accommodating container comprises:

a loading frame including a loader configured to accommodate an object that is to be washed;

a roller configured to be rotatable to move the loading frame into and out of the tub;

a shaft to rotatably support the roller; and a roller frame formed to extend from an outer edge of a side of the loading frame along a horizontal direction of the side of the loading frame so that the roller frame together with the outer edge of the side of the loading frame defines an arrangement space in which the roller and the shaft are to be arranged, wherein an opening to the arrangement space is defined by an upper surface of the roller frame and an upper surface of the loading frame facing a top wall of the tub and is between the loading frame and the inner wall of the tub while the accommodating container is inside the tub, and wherein, while the shaft is accommodated in the arrangement space formed by the roller frame together with the loading frame, a first end of the shaft is supported by the loading frame and a second end of the shaft opposite to the first end is supported by the roller frame, and wherein the loading frame and the roller frame are provided to be movable relative to the tub together with the roller accommodated in the arrangement space.

18. The dish washer of claim 17, wherein the arrangement space opens in a vertical direction of the tub.

19. A dish washer comprising:

a main body;

a tub positioned inside the main body;

a loading frame including an accommodating space configured to receive an object that is to be washed;

a roller frame formed to extend from an outer edge of a side of the loading frame along a horizontal direction of the side of the loading frame so that the roller frame together with the outer edge of the side of the loading frame defines an arrangement space, wherein an opening to the arrangement space is defined by an upper surface of the roller frame and an upper surface of the loading frame and is along a vertical direction of the tub and facing a top wall of the tub while the loading frame is inside the tub;

a roller configured to be rotatable in the arrangement space to move the loading frame into and out of the tub; and a shaft to be accommodated in the arrangement space formed by the roller frame together with the loading frame and rotatably support the roller; wherein while the shaft is accommodated in the arrangement space, a first end of the shaft and a second end of the shaft are respectively supported on the loading frame and the roller frame, the second end being opposite to the first end, wherein the roller frame comprises:

a support frame on which the second end of the shaft is supported; and an extension frame to connect the support frame with the loading frame, wherein the loading frame and the roller frame are provided to be movable relative to the tub together with the roller accommodated in the arrangement space.

* * * * *